US006315178B1

(12) United States Patent
Nobata

(10) Patent No.: US 6,315,178 B1
(45) Date of Patent: Nov. 13, 2001

(54) RUCKSACK

(75) Inventor: Tsuneo Nobata, Osaka (JP)

(73) Assignee: Louis Colbert Company Limited, Kowloon (HK)

( * ) Notice: Subject to any disclaimer, the term of this patent is extended or adjusted under 35 U.S.C. 154(b) by 0 days.

(21) Appl. No.: 09/543,863

(22) Filed: Apr. 5, 2000

(30) Foreign Application Priority Data

Sep. 22, 1999 (JP) ..... 11-007259

(51) Int. Cl.[7] ..... A45F 4/02; A45F 3/04

(52) U.S. Cl. ..... 224/153; 224/627; 224/576; 2/94; 190/1; 190/26

(58) Field of Search ..... 224/153, 627, 224/575, 576, 577; 2/94; 190/1, 26; 150/159

(56) References Cited

U.S. PATENT DOCUMENTS 3,228,034 * 1/1966 Grove ..... 190/1 X
3,989,080 * 11/1976 Koszegi .
5,010,987 * 4/1991 Evans ..... 190/26
5,123,117 6/1992 Prendergast .
5,165,111 * 11/1992 Lieberman ..... 224/153 X
5,407,112 * 4/1995 Christodoulou et al. ..... 224/153
5,439,153 8/1995 Murdoch et al. .
5,649,658 * 7/1997 Hoffman et al. ..... 224/153 X
5,988,474 * 11/1999 Smith, II et al. ..... 224/578

FOREIGN PATENT DOCUMENTS 1604548 12/1981 (GB) .
WO 96/19929 7/1996 (WO) .

* cited by examiner

*Primary Examiner*—Gregory M. Vidovich
(74) *Attorney, Agent, or Firm*—Rabin & Berdo, P.C.

(57) ABSTRACT

A rucksack is provided on its rear surface with a flap (5) which serves as a cover attached at its lower edge to the rucksack body (2). A waterproof skirt (20) is attached to the inside of the flap. When not in use the skirt is housed within the flap which is kept closed. In the event of rain the flap and the skirt can be deployed over the main body of the rucksack thus protecting the contents of the rucksack from the rain.

13 Claims, 11 Drawing Sheets

RUCKSACK

BACKGROUND OF THE INVENTION

The present invention relates to a carrying bag commonly known as a rucksack, knapsack or back-pack.

With the use of known rucksacks it is common practice to store rainwear in a pocket or pouch of the rucksack. In the event of rain, the rucksack will be removed, a raincoat taken out and put on, and the rucksack placed over the raincoat thus exposing the rucksack to the weather with consequential soaking of the contents of the rucksack.

Should a cape be worn it may cover both the hiker and the rucksack. However, this is not only unsightly but movement by the user whilst walking is restricted.

SUMMARY OF THE INVENTION

It is an aim of the invention to provide a rucksack which has readily deployable waterproof protection for covering the rucksack.

A further aim of the invention is to provide a combination rucksack and raincoat.

According to the invention, there is provided a rucksack having a flap provided at one wall of the body portion of the rucksack, characterised in that the flap is provided with a waterproof skirt attached to the inside surface of the flap, said skirt being housed on the inside of the flap when not in use and being deployable over the main body portion of the rucksack when in use.

BRIEF DESCRIPTION OF THE DRAWINGS

The invention will now be described by way of example with reference to the accompanying drawings, in which.

DETAILED DESCRIPTION OF THE INVENTION

Figure 1:
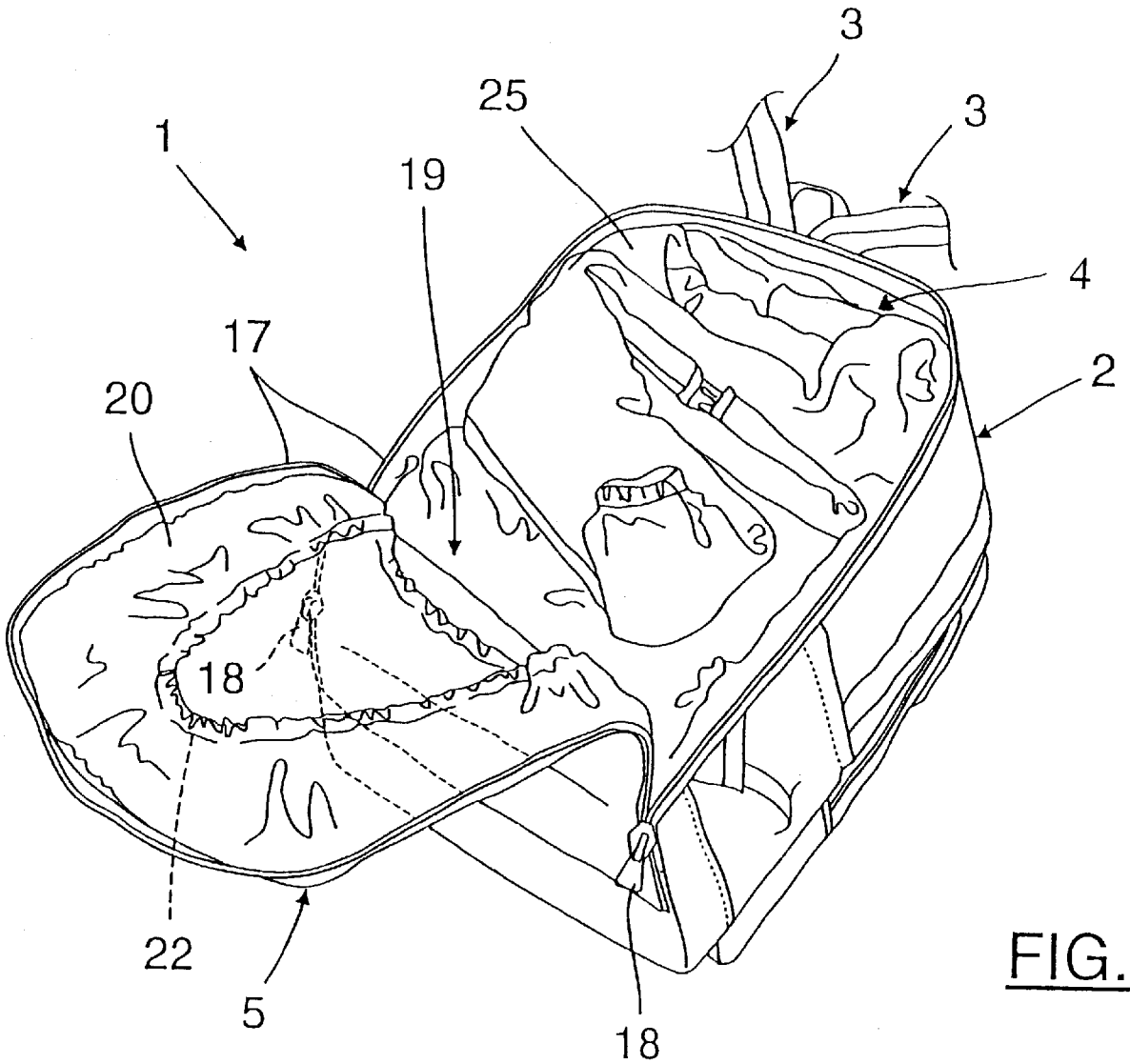
FIG. 1 shows a perspective view of the rucksack in one form of the invention with its flap fully open.

The rucksack 1 according to the invention comprises a bag body 2 of cloth material or synthetic fiber, having shoulder straps 3. At the rear wall 4 of the body 2, i.e. that which is close to the user's back, there is provided a flap 5 covering substantially the entire rear wall and secured at its lower edge by stitching and at its other three edges by a zip fastener 17, to the body 2. The zip is operated by sliders 18.

Figure 6:
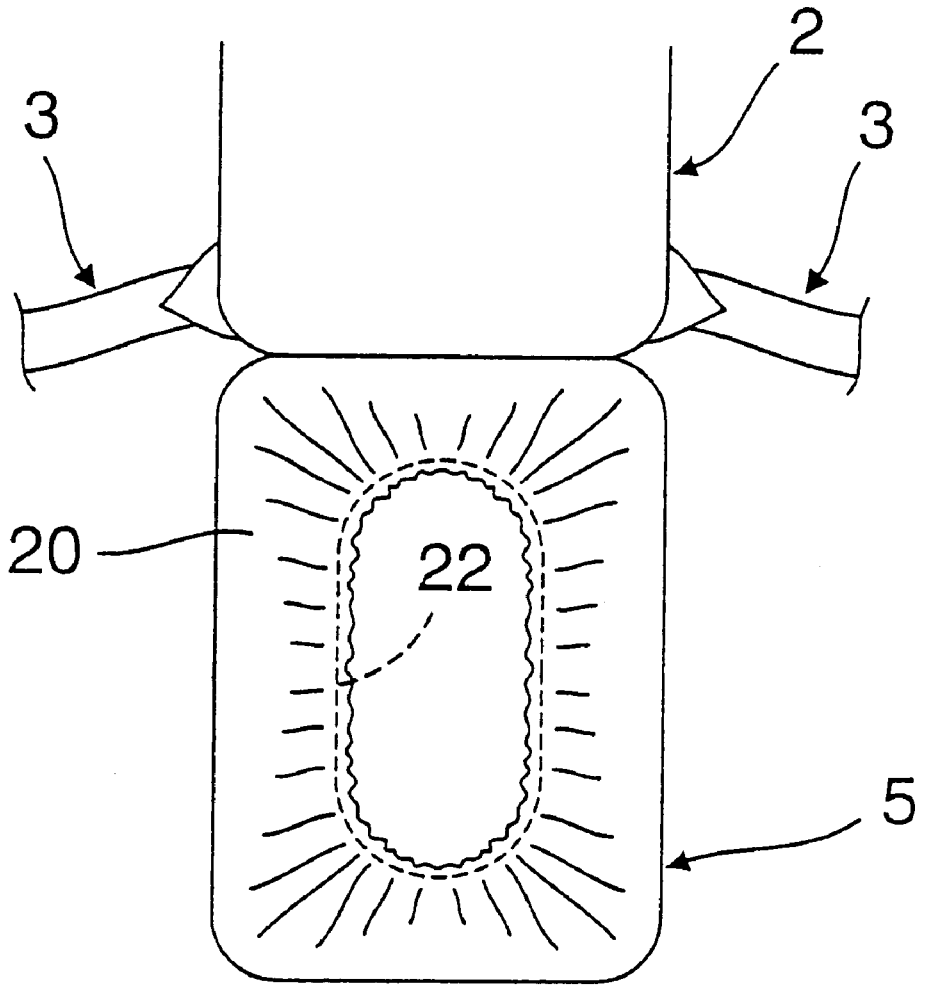
FIG. 6 shows the flexible waterproof skirt attached at its outer edge to the outer edge of the flap.
Figure 7:
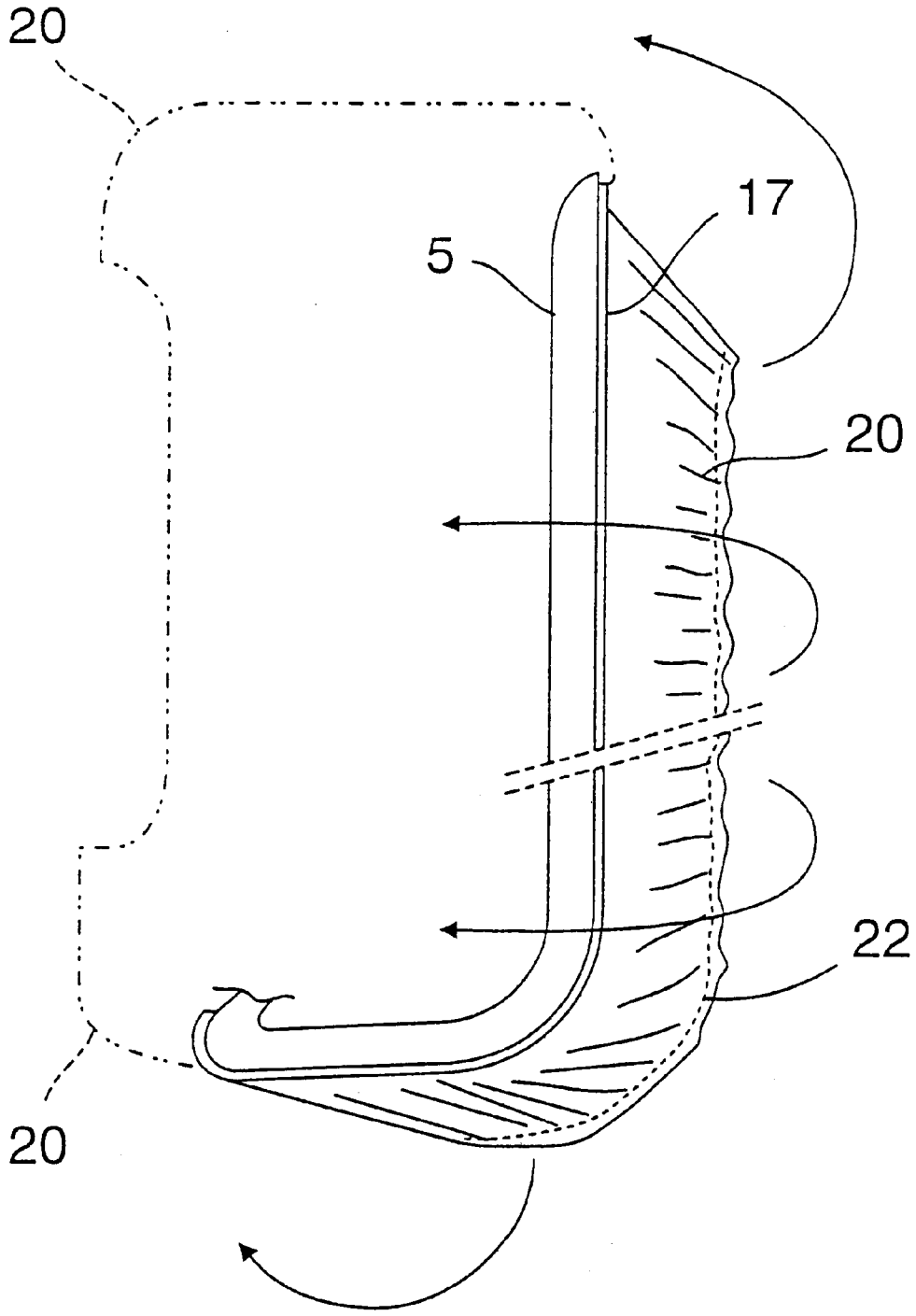
FIG. 7 shows the skirt partially expanded ready for deployment over the rucksack body.

The flap 5 is provided at its margin with a flexible waterproof skirt 20, which in turn is provided, at its distal margin, with an elastic strip or tie-pull 22. The skirt is preferably ruched as shown in FIG. 6.

The space between the rear wall 4 and the flap 5 serves as a pouch 19, to receive an article such as a raincoat 25.

Figure 2:
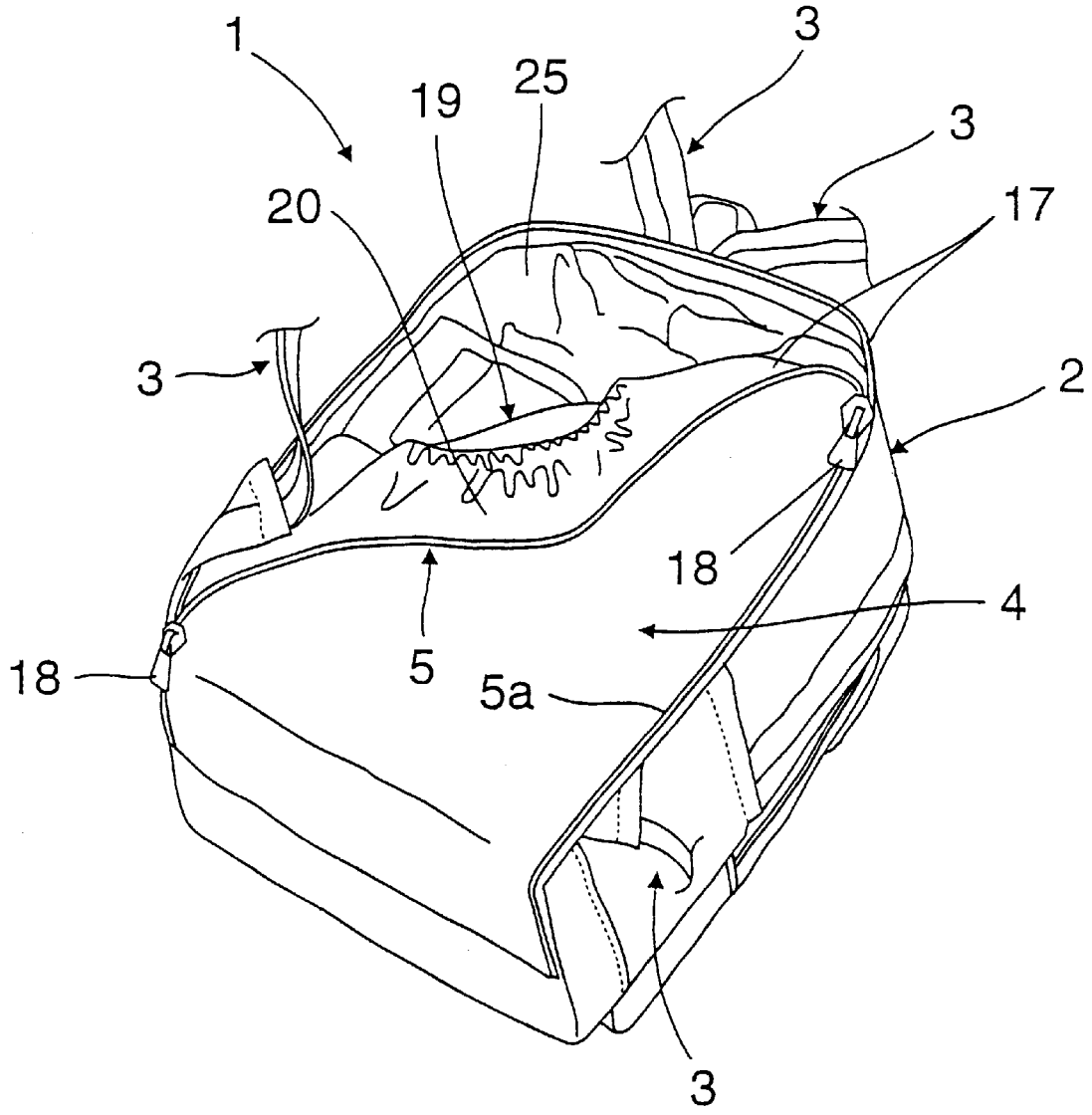
FIG. 2 shows the flap closed save for one corner thereof.
Figure 3:
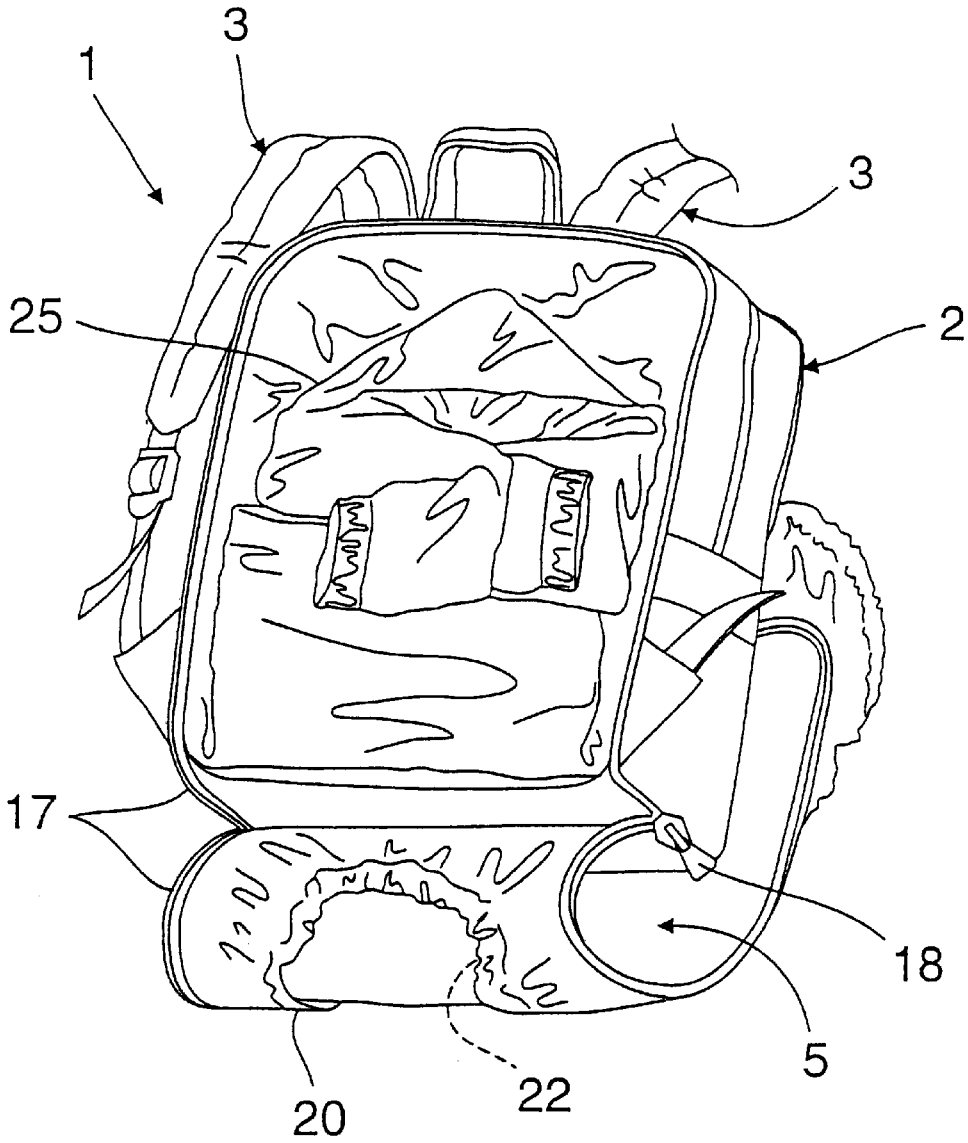
FIG. 3 shows the flap turned around the rucksack body in readiness for deployment of the waterproof skirt.
Figure 4:
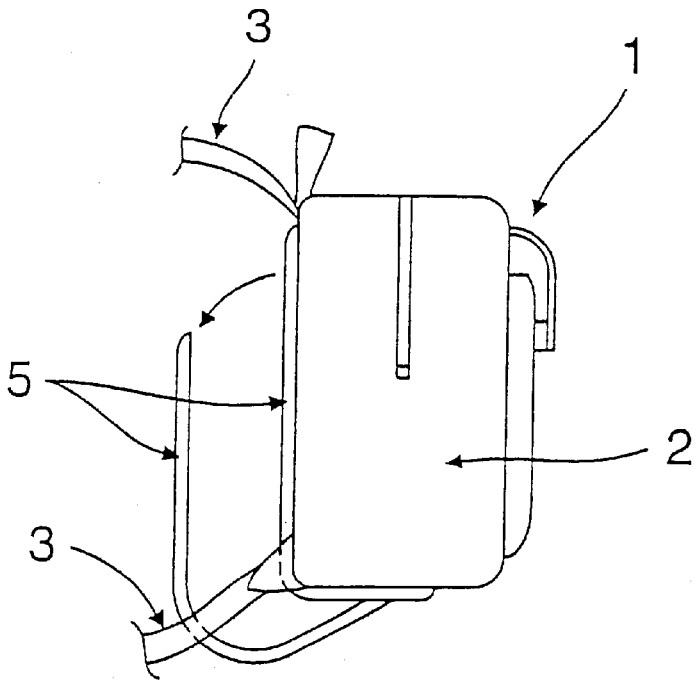
FIGS. 4 and 5 show the sequential positions of the flap as it moves from a stowage position to a position ready for skirt deployment.
Figure 5:
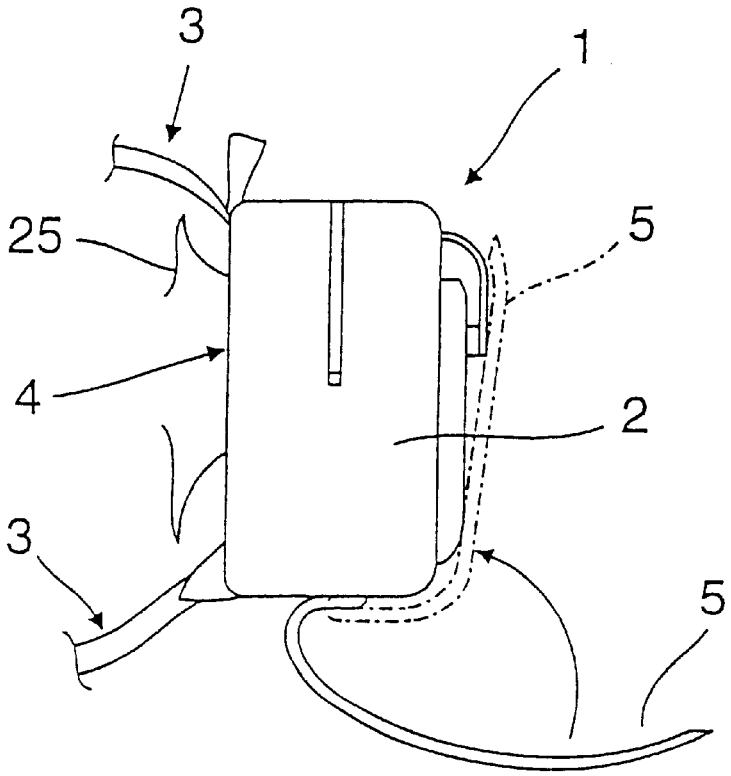

In the event of rain the flap 5 is unfastened along its top and two sides and is swung from its position at the rear of the body to a position engaging the front of the body, the sequential movements of the flap being shown in FIGS. 4 and 5. To facilitate this movement the zip fastener extends beneath the body to a position mid-way across the lower surface of the body (FIG. 2).

On reaching the position facing the front of the body, the skirt 20 is pulled over the rucksack body by stretching the elastic strip 22. It will be appreciated that the skirt itself may be made of a flexible, elastically stretchable material thus making the provision of an elastic strip or tie-pull redundant.

The flap 5 and skirt 20 together cover a substantial portion of the rucksack body, except for a small area adjacent the user's back, which area is in any event closed by the back of the raincoat worn by the user. The flap and skirt are retained by the elastic strip.

Figure 8:
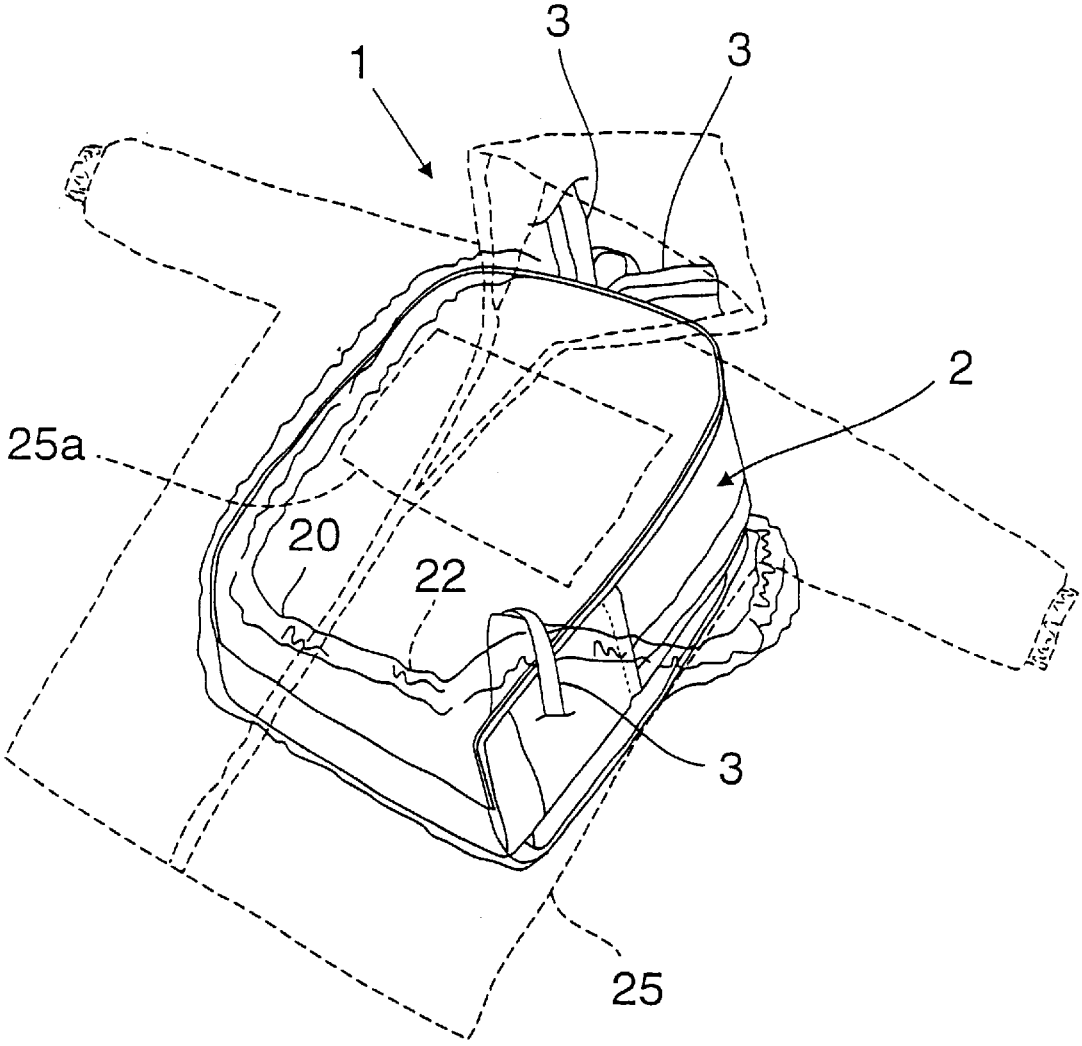
FIG. 8 shows the skirt substantially in position to cover the rucksack save for one corner thereof (the raincoat having been removed from the opened pouch and being shown in broken lines)
Figure 9:
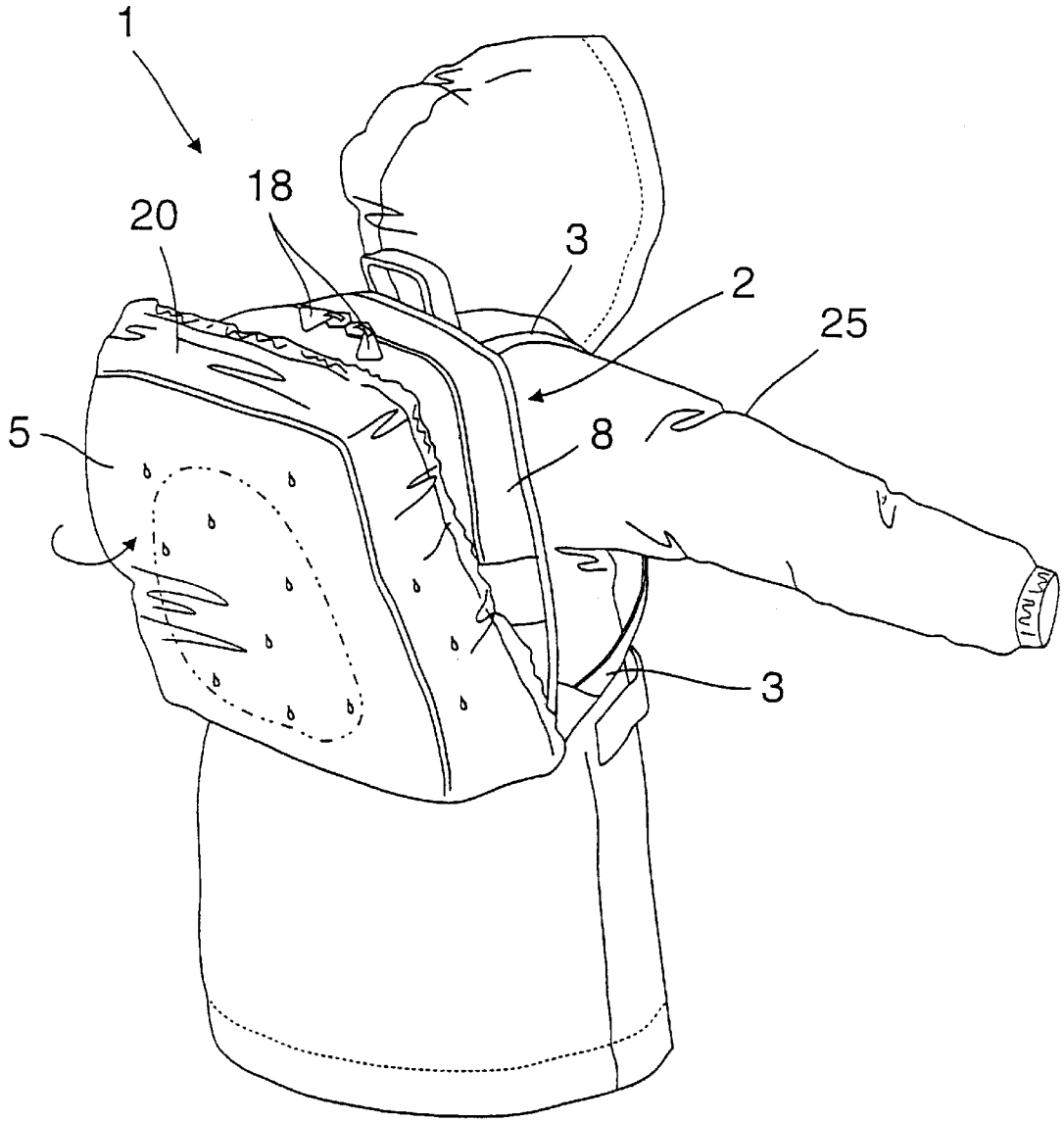
FIG. 9 shows the skirt engaged around the rucksack ready for final positioning.
Figure 10:
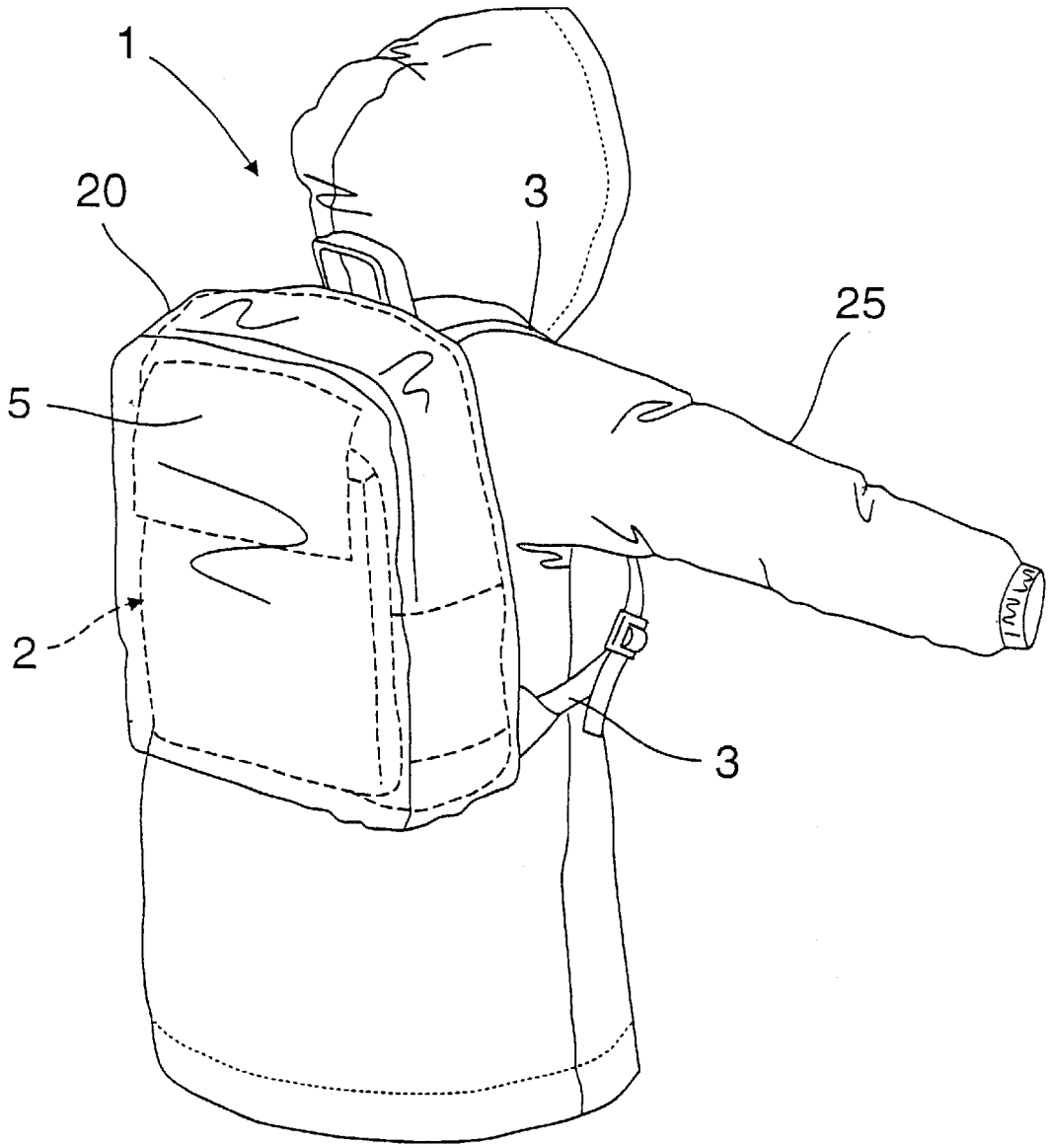
FIG. 10 shows the flap and its skirt fully deployed over and around the rucksack body.

In a further form of the invention as shown in FIG. 8 the raincoat, which is stowed in the pouch, is connected to the rear wall of the body 2 within the pouch at a central rectangular region 25*a*.

With the distal margin of the skirt engaged firmly along and against the joint between the back of the raincoat and the rear wall 4 in the region 25*a* by the tension of the elastic strip 22, a substantially watertight seal is formed.

After use the wet raincoat may be stowed away within the pouch 19. Preferably, the flap is made of or includes a waterproof or water resistant material. By making the flap and also the rear wall of the bag of waterproof material, moisture is prevented from seeping into the bag and dampening the contents.

Figure 11:
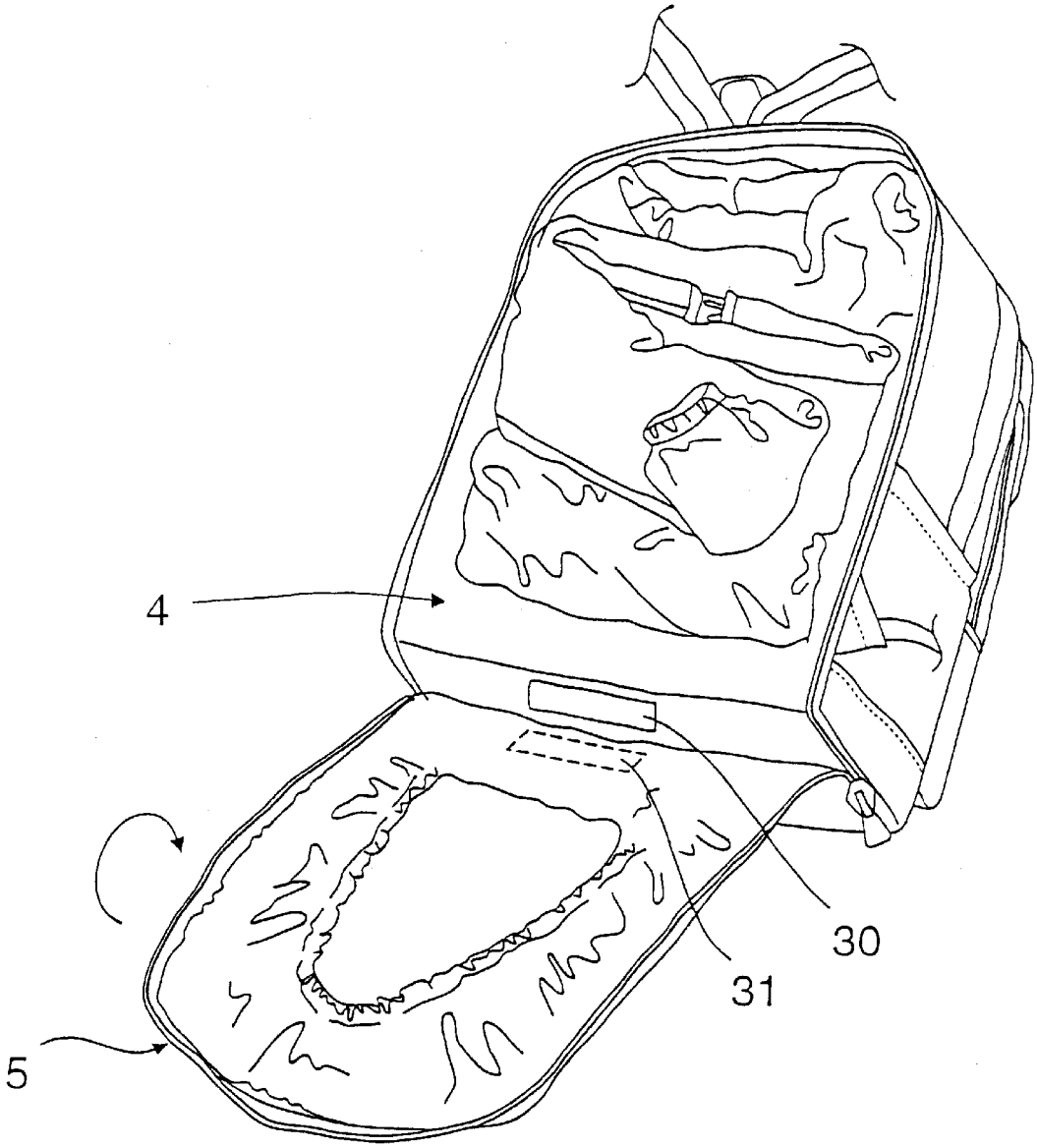
FIG. 11 shows a modification of the invention in that VELCRO (Registered Trade Mark) tapes are provided to secure the flap in a furled state beneath the rucksack body.
Figure 12:
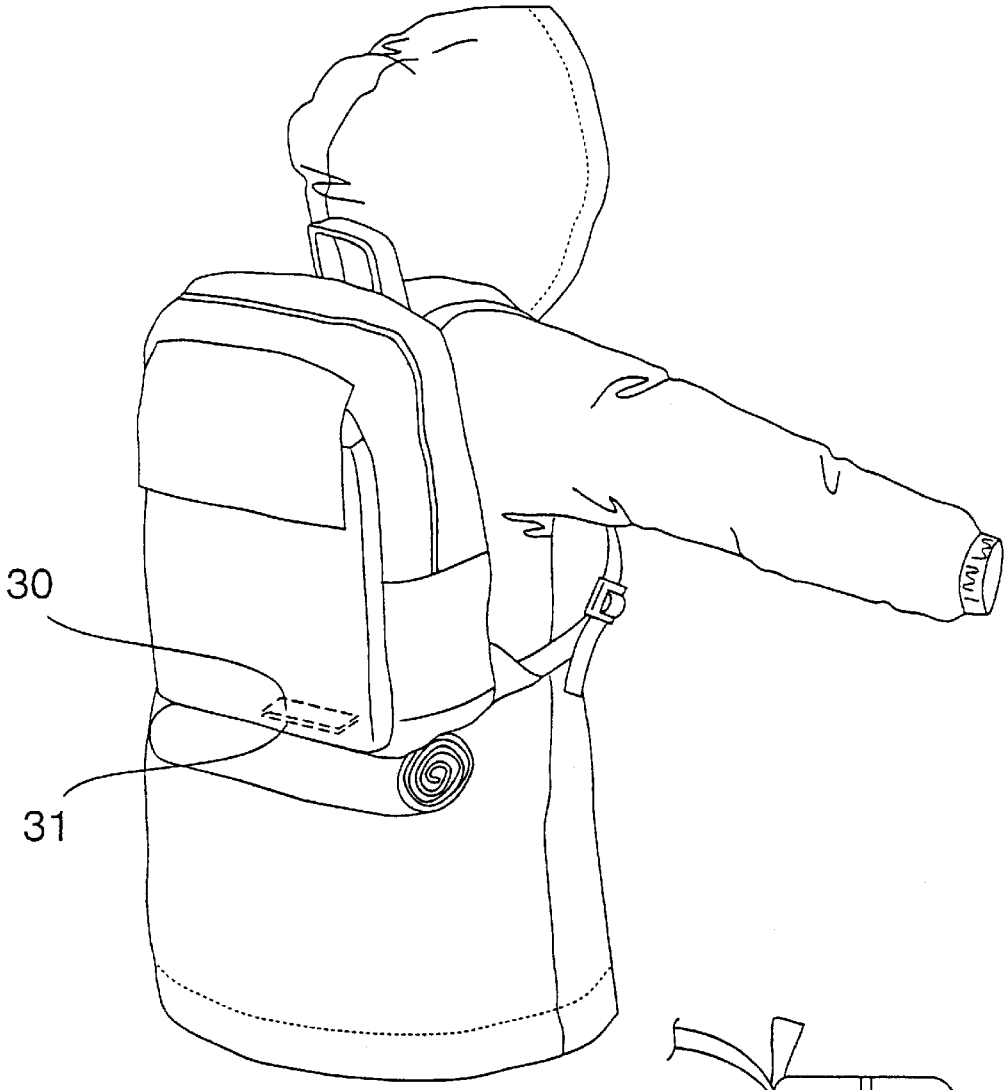
FIG. 12 shows the rucksack with the furled flap stowed beneath.
Figure 13:
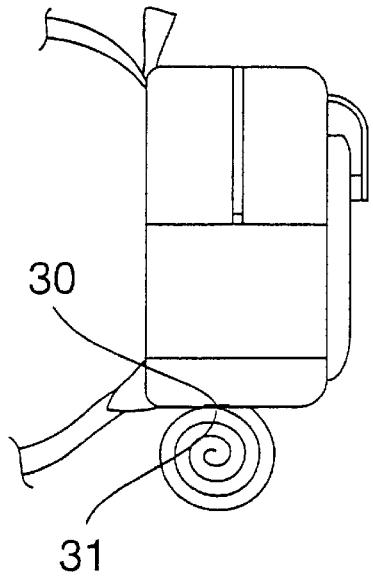
FIG. 13 is a side view of the rucksack with the furled flap.

As shown in FIGS. 11, 12 and 13, two strips of hook-and-loop fastening material 30, 31, such as VELCRO (Registered Trade Mark) may be provided one on the underside of the rucksack body and the other on the outer proximal end of the flap 5.

In the event that the flap and the skirt are not needed to cover the rucksack (the raincoat being used merely as a windcheater) the flap with the skirt may be furled and held in this state by the co-operating VELCRO strips (see FIGS. 12 and 13). Ties may be used instead of VELCRO strips.

The flap may be provided at any of the surfaces of the rucksack. Should the flap be provided at any one of the narrow sides, top or bottom, the skirt will be of a suitably larger size than that shown in the drawings.

The flap may be permanently secured along one edge as shown in the drawings or may be detachably secured by means of hooks, buttons, zip fastener or pull-string.

What is claimed is:

1. A rucksack, comprising:

a body portion having a back wall and a front; and a flap having a first portion attached to said body portion and another portion; fastenable to said body portion to substantially completely cover said back wall, and said another portion being unfastenable from said body portion to be positioned to substantially completely cover the front of said body portion, said flap being provided with a waterproof skirt attached to an inside surface of said flap, said skirt being disposed on the inside of the flap and being between said flap and said back wall when said another portion is fastened to said body portion to substantially completely cover said back wall, and when said another portion is unfastened from said body portion, said skirt being deployable over said body portion of the rucksack when in use to retain said flap over the front of said body portion.

2. A rucksack as claimed in claim 1, wherein said flap is substantially rectangular and has four edges, said flap being attached at a lower edge thereof to said body portion, the three other edges being fastenable to said body portion by a fastening device.

3. A rucksack as claimed in claim 1, wherein said skirt is provided at its distal margin with an elastic strip or tie-string.

4. A rucksack as claimed in claim 1, wherein said skirt is made of an elastically stretchable waterproof material.

5. A rucksack as claimed in claim 1, wherein when said flap is fastened to said body portion of the rucksack to cover said back wall, said flap and said back wall form a pouch therebetween for the storage of articles.

6. A rucksack as claimed in claim 1, wherein said flap is contiguous with said back wall of the rucksack.

7. A rucksack as claimed in claim 1, wherein said flap is made of or includes waterproof or water resistant material.

8. A rucksack as claimed in claim 1, wherein said flap forms a pouch with said back wall, said back wall being adapted to engage a user's back.

9. A rucksack, comprising:

a body portion having a wall;

a flap provided at the wall, said flap being provided with a waterproof skirt attached to an inside surface of said flap, said skirt being disposed on the inside of the flap when not in use and being deployable over said body portion of the rucksack when in use; and a first and second co-operating securing devices provided respectively at an underside of the body portion and at a lower rear outer surface of said flap, whereby after furling said flap, said first and second securing devices are brought into engagement.

10. A rucksack as claimed in claim 9, wherein the securing devices comprise tapes or strips of hook and loop fasteners.

11. A rucksack, comprising:

a body portion having a wall;

a flap provided at the wall, said flap being provided with a waterproof skirt attached to an inside surface of said flap, said skirt being disposed on the inside of the flap when not in use and being deployable over said body portion of the rucksack when in use; and a raincoat provided between said flap and said wall of the body portion, a back panel of said raincoat being-secured to said wall.

12. A rucksack as claimed in claim 11, wherein said back panel is secured to said wall over a substantially rectangular region.

13. A rucksack as claimed in claim 12, wherein a distal edge of said skirt is complementary in size to the rectangular region whereby with said skirt deployed a substantially watertight seal is provided along a joint between said back panel and said wall.

* * * * *